US007244107B2

(12) United States Patent
Cheng

(10) Patent No.: US 7,244,107 B2
(45) Date of Patent: Jul. 17, 2007

(54) HOME OXYGEN-COMPRESSION APPARATUS

(75) Inventor: Chen-Bong Cheng, Kowloon (HK)

(73) Assignee: Merits Health Products Co., Ltd., Taichung (TW)

( * ) Notice: Subject to any disclaimer, the term of this patent is extended or adjusted under 35 U.S.C. 154(b) by 0 days.

(21) Appl. No.: 11/089,654

(22) Filed: Mar. 24, 2005

(65) Prior Publication Data

US 2006/0216158 A1 Sep. 28, 2006

(51) Int. Cl.
*F04B 19/02* (2006.01)
*F04B 25/00* (2006.01)
*F04B 27/00* (2006.01)

(52) U.S. Cl. ..... 417/266; 417/464

(58) Field of Classification Search ..... 417/244, 417/254, 266, 273, 464; 91/210
See application file for complete search history.

(56) References Cited

U.S. PATENT DOCUMENTS 158,729 A * 1/1875 Neumeyer ..... 417/464
905,973 A * 12/1908 Zeitlin ..... 417/464
915,759 A * 3/1909 Foll ..... 417/464
2,105,765 A * 1/1938 Fourness ..... 417/464
2,628,015 A * 2/1953 Neugebauer et al. ..... 417/266
2,673,519 A * 3/1954 Halliburton ..... 417/464
3,129,668 A * 4/1964 Manke et al. ..... 417/464
3,216,648 A * 11/1965 Ford ..... 417/265
3,227,094 A * 1/1966 Cailloux ..... 417/464
5,163,818 A * 11/1992 Betsill et al. ..... 417/18
5,354,361 A 10/1994 Coffield ..... 95/103
5,988,165 A 11/1999 Richey, II et al. ..... 128/205.12
6,183,211 B1 * 2/2001 Wood ..... 417/254

* cited by examiner

*Primary Examiner*—Michael Koczo, Jr.
(74) *Attorney, Agent, or Firm*—James H. Walters

(57) ABSTRACT

An oxygen-compression apparatus has a driving device, multiple rotating wheels, multiple driving rings, multiple rocking cylinders and multiple connecting hoses. The driving device has a driving shaft with a central axis. The rotating wheels are eccentrically attached on and rotated with the driving shaft and are located respectively at different angles relative to the central axis of the driving shaft. The driving rings are rotatably mounted respectively around the rotating wheels. The rocking cylinders are connected respectively to the driving rings and each has a housing and a piston rod. The piston rod has a first end extending into the inner space of the housing to form a compression chamber in the inner space and a second end pivotally connected to a corresponding one of the driving rings. The connecting hoses are connected between the compression chambers of adjacent rocking cylinders.

11 Claims, 5 Drawing Sheets

HOME OXYGEN-COMPRESSION APPARATUS

BACKGROUND OF THE INVENTION

1. Field of the Invention

The present invention relates to an oxygen-compression apparatus, and more particularly to a domestic oxygen-compression apparatus that can conveniently store oxygen in a tank with a desired pressure.

2. Description of Related Art

Oxygen is commonly applied to assist a patient's breathing, and home oxygen concentrators have been utilized to supply patients with oxygen at home. A conventional apparatus for producing oxygen is disclosed in U.S. Pat. No. 5,988,165, entitled "Apparatus and Method for Forming Oxygen-Enriched Gas and Compression Thereof for High-Pressure Mobile Storage Utilization". The '165 Patent can produce enriched oxygen and compress the oxygen to portable container at a desired high pressure, i.e. above 2000 psi, such that the patient can carry the container with compressed oxygen to any desired location for use. The '165 Patent provides a compressor composed of a crankshaft, multiple connecting rods, multiple cylinders and multiple pistons. The connecting rods are connected to the crankshaft. The pistons are connected respectively to the connecting rods and extend respectively into the cylinders. With the rotation of the crankshaft, the pistons will compress oxygen in the cylinder with the transmission of the connecting rods, such that the oxygen will be compressed to a desired high pressure and is then collected in a gas tank. However, the '165 Patent needs an auxiliary piston to eliminate lateral force, such that the compressor of the '165 Patent takes up a large space and has a complex structure. In addition, the cylinders of the '165 Patent only has a short stroke and must be connected to a specific concentrator, so that the compressor of the '165 Patent is inconvenient in operation. To overcome the shortcomings, the present invention tends to provide an improved home oxygen-compression apparatus to mitigate or obviate the aforementioned problems.

SUMMARY OF THE INVENTION

The main objective of the invention is to provide an oxygen compression apparatus that can conveniently pump oxygen into a gas tank at a desired pressure and can simultaneously apply oxygen to a user with an auxiliary output hose. The oxygen-compression apparatus has a driving device, multiple rotating wheels, multiple driving rings, multiple rocking cylinders and multiple connecting hoses. The driving device has a driving shaft with a central axis. The rotating wheels are eccentrically attached on and rotated with the driving shaft and are located respectively at different angles relative to the central axis of the driving shaft. The driving rings are rotatably mounted respectively around the rotating wheels. The rocking cylinders are connected respectively to the driving rings and each has a housing and a piston rod. The housing has an inner space. The piston rod has a first end extending into the inner space of the housing to form a compression chamber in the inner space and a second end connected to a corresponding one of the driving rings. An input hose is connected to the compression chamber of a first of the rocking cylinders and adapted to be connected to an oxygen source. An output hose is connected to the compression chamber of a second of the rocking cylinders.

Other objects, advantages and novel features of the invention will become more apparent from the following detailed description when taken in conjunction with the accompanying drawings.

DETAILED DESCRIPTION OF PREFERRED EMBODIMENT

Figure 1:
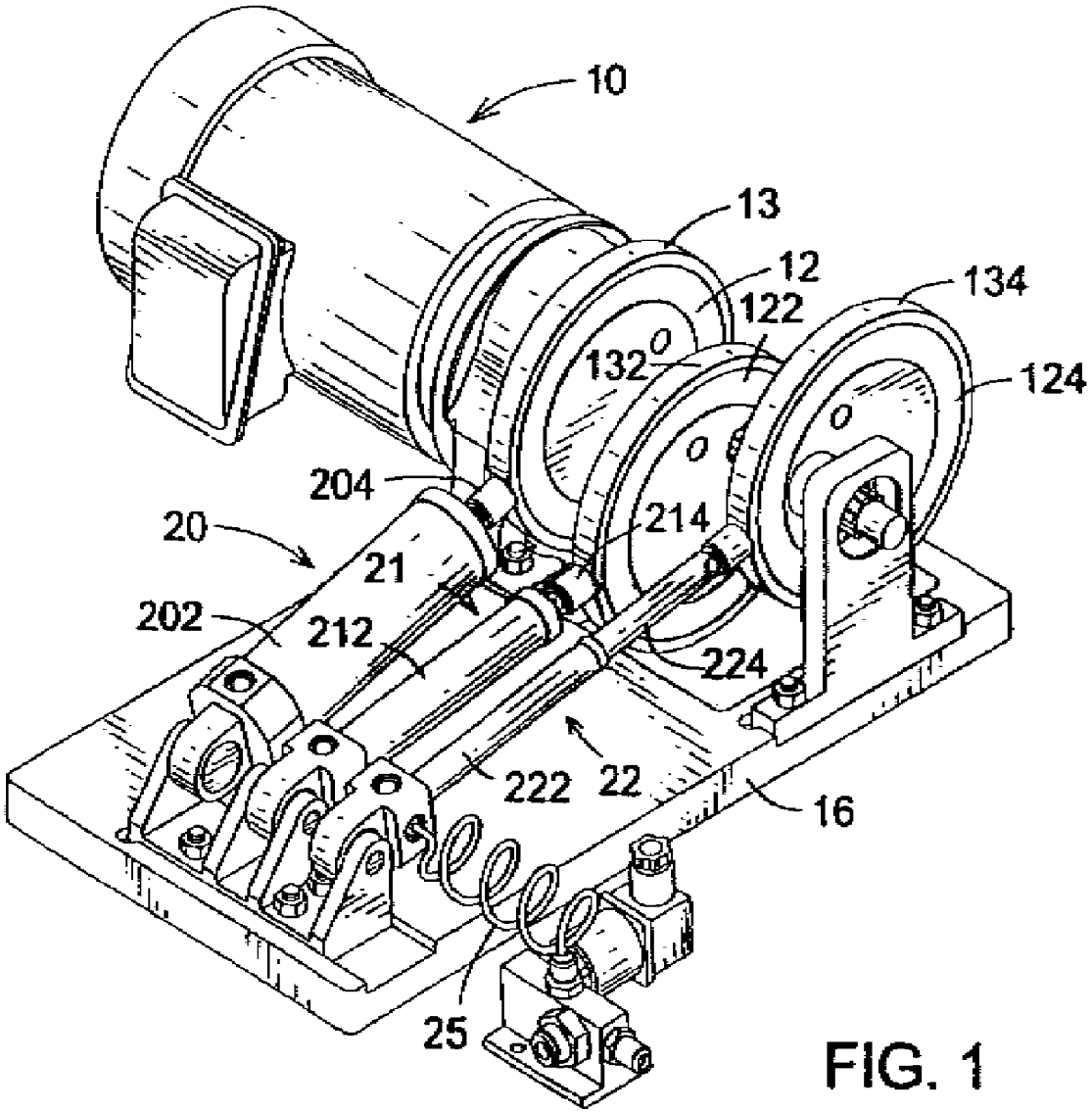
FIG. 1 is a perspective view of an oxygen-compression apparatus in accordance with the present invention.
Figure 2:
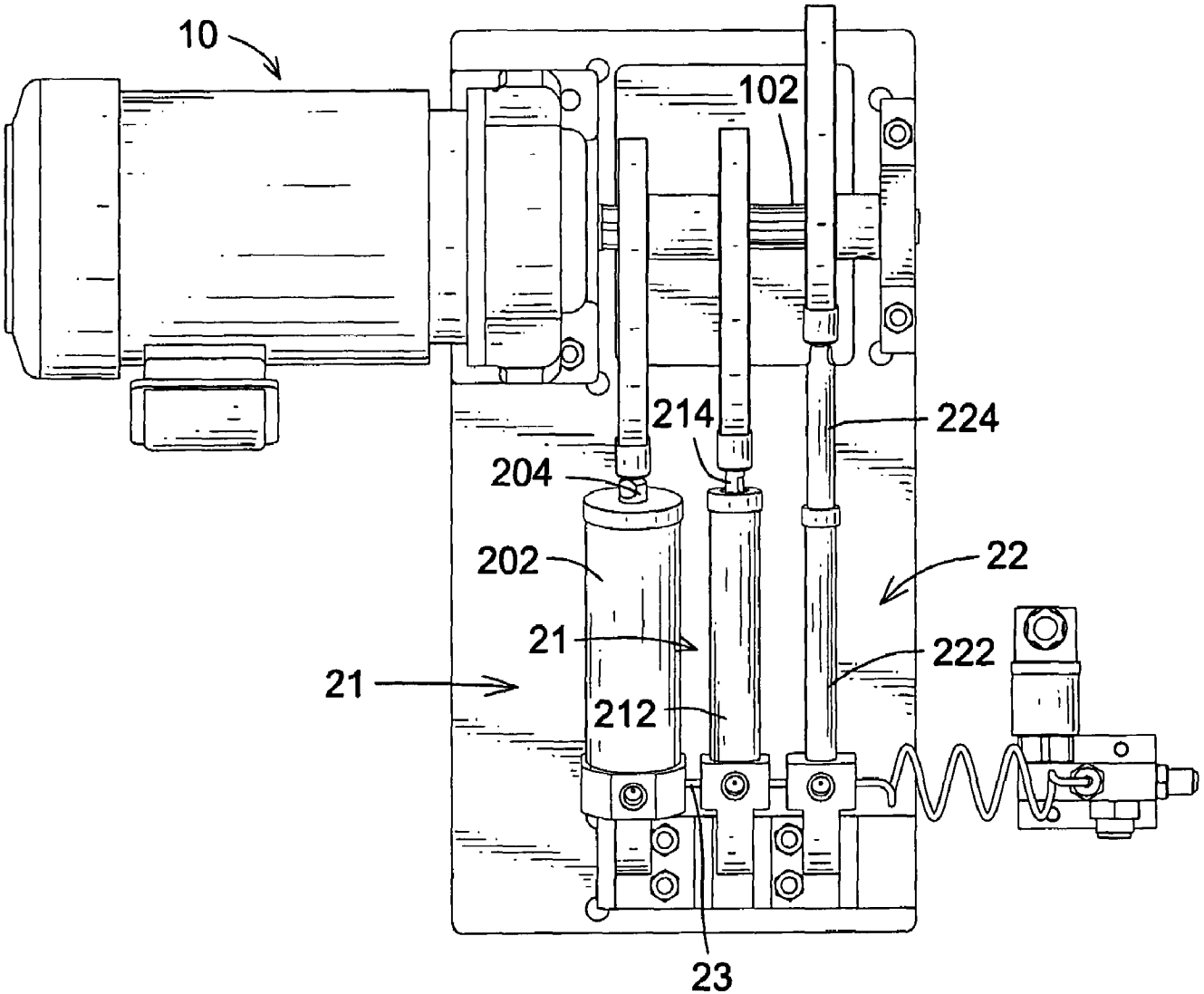
FIG. 2 is a top view of the oxygen-compression apparatus in FIG. 1.
Figure 3:
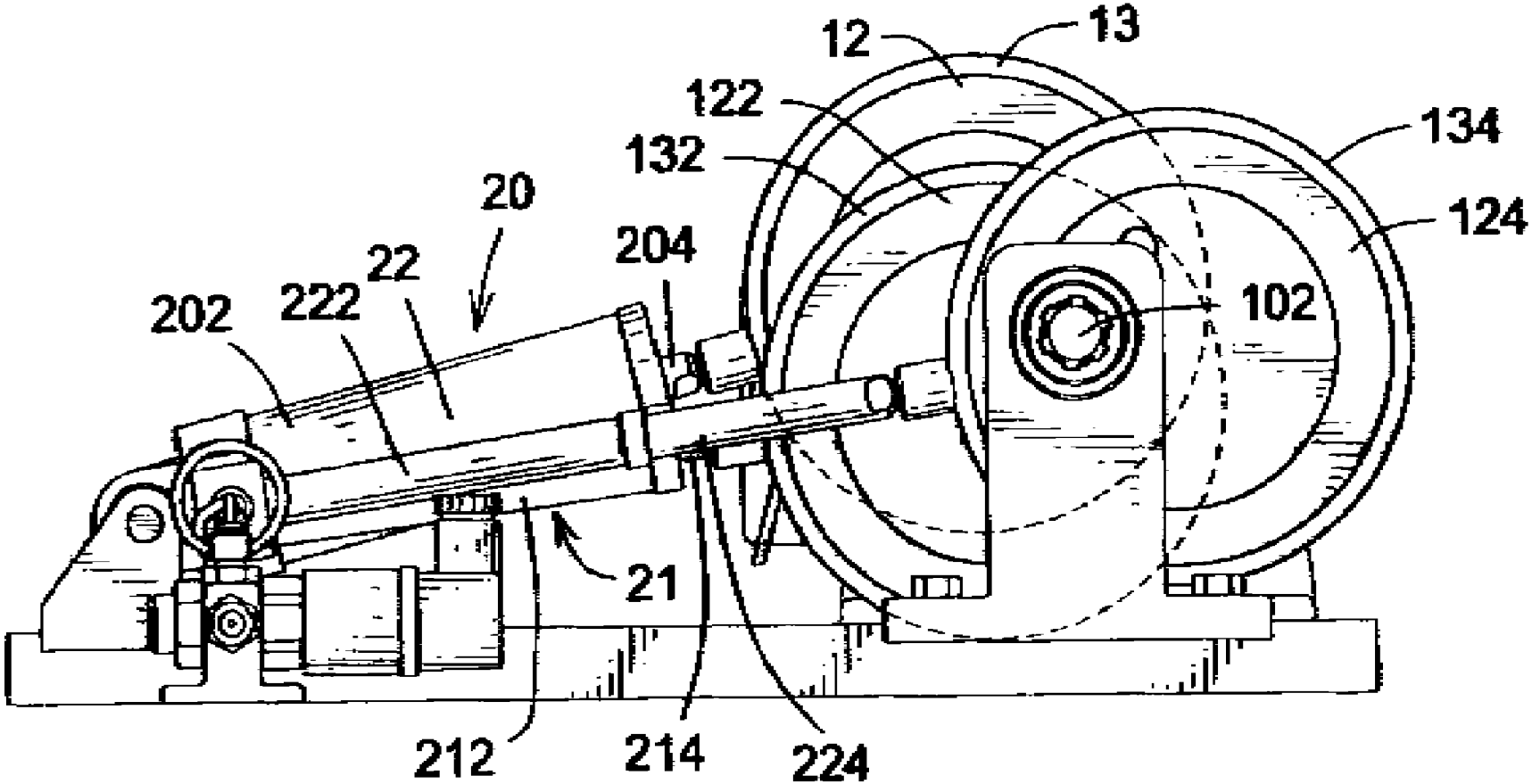
FIG. 3 is a side plan view of the oxygen-compression apparatus in FIG. 1.
Figure 4:
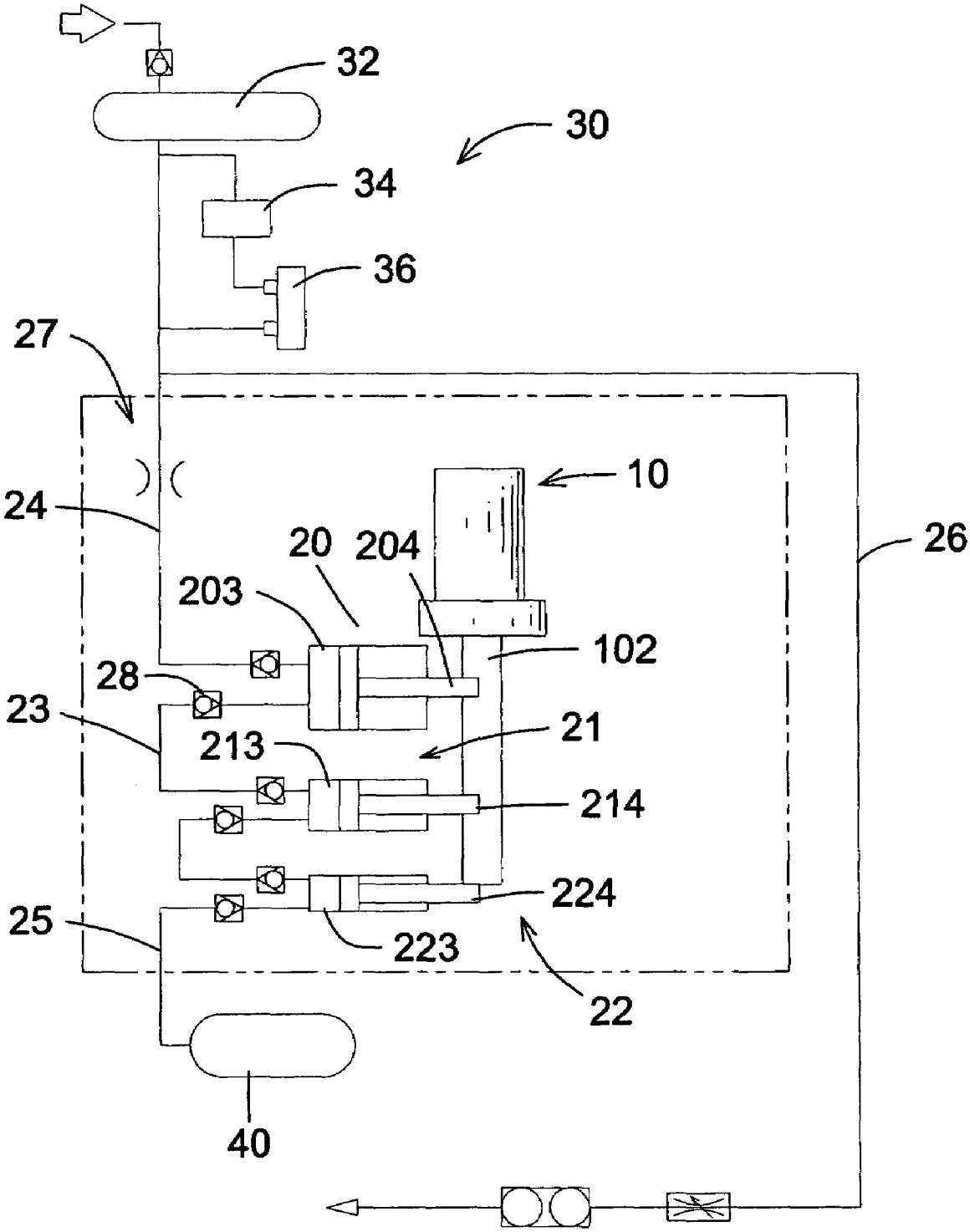
FIG. 4 is a schematic view of an oxygen-compression apparatus in accordance with the present invention.

With reference to FIGS. 1 to 4, an oxygen-compression apparatus in accordance with the present invention comprises a driving device (10), multiple rotating wheels (12, 122,124), multiple driving rings (13,132,134), multiple rocking cylinders (20,21,22) and multiple connecting hoses (23). The driving device (10) has a driving shaft (102) with a central axis and optionally a motor with a gear box.

The rotating wheels (12,122,124) are eccentrically attached on and rotated with the driving shaft (102) and are located respectively at different angles relative to the central axis of the driving shaft (102). In a preferred embodiment, three rotating wheels (12,122,124) are mounted on the driving shaft (102) and are located at 120° relative to each other and the central axis of the driving shaft (102).

The driving rings (13,132,134) are rotatably mounted respectively around the rotating wheels (12,122,124). In the preferred embodiment, three driving rings (13,132,134), including a first driving ring (13), a second driving ring (132) and a third driving ring (134) are provided.

The rocking cylinders (20,21,22) are connected respectively to the driving rings (13,132,134) and each has a housing (202,212,222) and a piston rod (204,214,224). In the preferred embodiment, three rocking cylinders (20,21, 22), including a first rocking cylinder (20), a second rocking cylinder (21) and a third rocking cylinder (22) are provided. The housing (202,212,222) has an inner space. The piston rod (204,214,224) has a first end extending into the inner space of the housing (202,212,222) to form a compression chamber (203,213,223) in the inner space and a second end securely connected to a corresponding one of the driving rings (13,132,134). The compression chamber (203) of the first rocking cylinder (20) is connected to an oxygen source with an input hose (24), and the compression chamber (223) of the third rocking cylinder (22) is connected to a gas tank (40) with an output hose (25). In a preferred embodiment, the rocking cylinders (20,21,22) have different compression ratios by means of different diameters of the compression chamber (203,213,223) of the rocking cylinders (20,21, 22). In addition, a base (16) is provided to support the rocking cylinders (20,21,22), and the housings (202,212,222) of the rocking cylinders (20,21,22) are pivotally attached to the base (16) at ends of the housings that are distal from the housing ends where the piston rods extend into the inner space of the housings.

The connecting hoses (23) are connected between the compression chambers (203,213,223) of adjacent rocking cylinders (20,21,22). In addition, multiple check valves (28) are attached respectively to the hoses (23,24,25) to form a one-way passage between the hoses (23,24,25) and the compression chambers (203,213,223) of the cylinders (20, 21,22).

Figure 5:
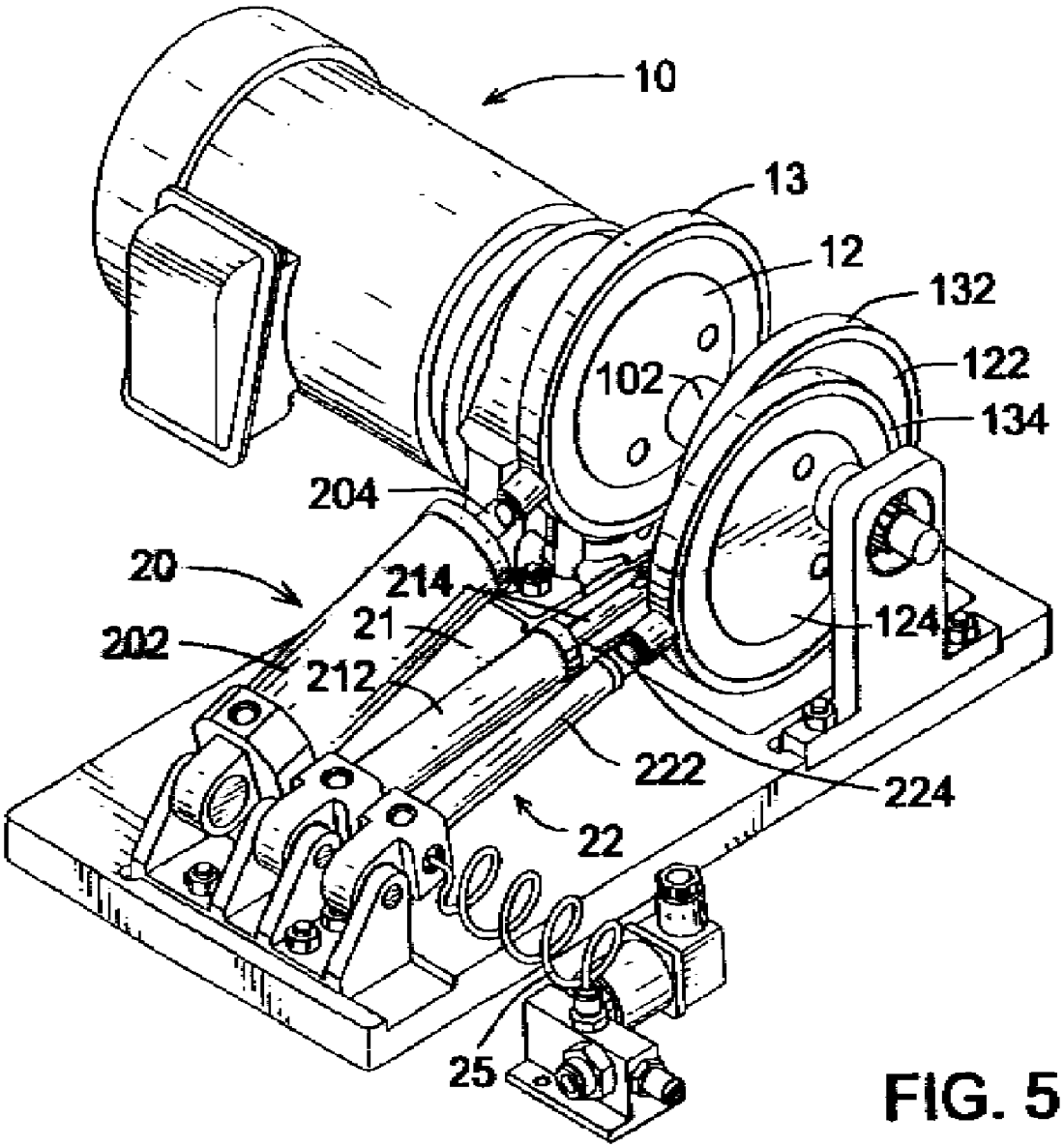
FIG. 5 is an operational perspective view of the oxygen-compression apparatus in FIG. 1 showing that the piston rods of the rocking cylinders are pushed or pulled when the rotating wheels rotates.

With further reference to FIG. 5, when the driving device (10) is switched on, the driving shaft (102) rotates and the rotating wheels (12,122,124) rotate with the driving shaft (102). With the eccentric arrangements of the rotating wheels (12,122,124) and the rotation arrangement between the driving rings (13,132,134) and the rotating wheels (12,122,124), the driving rings (13,132,134) will move forth and back relative to the driving shaft (102) while the rotating wheels (12,122,124) rotate with the driving shaft (102). Consequently, driving rings (13,132,134) will push or pull the connecting piston rods (204,214,224) of the rocking cylinder (20,21,22). When the first driving ring (13) moves to a position where the driving ring (13) pulls the corresponding piston rod (204) away from the housing (202) of the first cylinder (20), the compression chamber (203) in the first cylinder (20) is enlarged and the pressure in the compression chamber (203) is reduced. The oxygen provided from the oxygen source will be routed to and sucked into the compression chamber (203) in the first cylinder (20) through the input hose (24). With the movement of the first driving ring (13), the piston rod (204) of the first cylinder (20) will be pushed by the driving ring (13) and the space of the compression chamber (203) is reduced. Thus, the pressure in the compression chamber (203) in the first cylinder (20) increases, and the pressurized oxygen exits the first cylinder (20) and enters the compression chamber (213) in the second cylinder (21) through the connecting hose (23). At this time, the piston rod (214) on the second cylinder (21) is pulled by the corresponding driving ring (132) because of the different eccentric angles between of the rotating wheels (12,122). Consequently, the compression chamber (213) in the second cylinder (21) is enlarged and provides an extraction effect to the pressurized oxygen out of the first cylinder (20). When the second driving ring (132) moves to a position where the driving ring (132) pushes the piston rod (214) into the housing (212) of the second cylinder (21), the oxygen in the pressing chamber (213) will be compressed and exits the cylinder (21) under a high pressure. Similarly, the oxygen will be further compressed by the third cylinder (22), such that the compressed oxygen can be routed to and collected in a gas tank (40) with a desired high pressure through the output hose (25). Accordingly, the user can conveniently store or carry the compressed oxygen to any desired location.

With such an apparatus, an oxygen-compression apparatus with a simple structure is provided, and the cost for manufacturing the apparatus is low. In addition, because the cylinders (20,21,22) are alternately compressed with the driving rings (13,132,134), to compress the oxygen to a desired high pressure is efficient and takes a short time. Therefore, the user can easily store pressurized oxygen in gas tanks at home.

Furthermore, an auxiliary output hose (26) is attached to the input hose (24), such that oxygen supplied from the oxygen source can be applied to a user directly at a low pressure. The user can breathe and store oxygen with the apparatus at the same time, such that the use of the oxygen-compression apparatus in accordance with the present invention is versatile.

In addition, an oxygen concentration detecting device (30) is connected to the input hose (24) connected to the oxygen source to detect the concentration of the oxygen supplied from the oxygen source. The detecting device (30) comprises a buffer tank (32), a filter (34), an oxygen sensing unit (36) and a restrictor (27). The buffer tank (32) is connected to the oxygen source. The filter (34) is connected to the buffer tank (32). The oxygen sensing unit (36) is connected to the filter (34) to detect the concentration of the oxygen applied into the unit (36). The restrictor (27) is connected to the input hose (24), is electrically connected to the oxygen sensing unit (36) and can be a switch to close the passage of the input hose (24) until the restrictor (27) is opened.

With such an oxygen concentration detecting device (30), oxygen will be not applied to the cylinders (20,21,22) before the concentration of oxygen reaches a desired level. When the concentration of oxygen supplied from the oxygen source and detected by the oxygen sensing unit (36) reaches a predetermined level, the oxygen sensing unit (36) sends a signal to open the restrictor (27). Thereafter, oxygen at a desired concentration is applied to the cylinders (20,21,22) and is compressed to a desired pressure with the apparatus.

Furthermore, because the rocking cylinders (20,21,22) can eliminate lateral force automatically, so an auxiliary piston is unnecessary and the structure of the oxygen-compression apparatus of this invention is simplified. In addition, the rocking cylinders (20,21,22) have a longer stroke than a conventional one of the' 165 Patent and can be connected to all concentrators, such that the use and operation of the oxygen-compression apparatus in accordance with the present invention is convenient.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An oxygen-compression apparatus comprising:

a driving device having a driving shaft with a central axis;

multiple rotating wheels eccentrically attached on and rotated with the driving shaft and located respectively at different angles relative to the central axis of the driving shaft;

multiple driving rings rotatably mounted respectively around the rotating wheels;

multiple rocking cylinders connected respectively to the driving rings, having different compression ratios and each having a housing with an inner space; and a piston rod having a first end extending into the inner space of the housing to form a compression chamber in the inner space and a second end connected to a corresponding one of the driving rings;

multiple connecting hoses respectively connected between the compression chambers of adjacent rocking cylinders, an input hose connected to the compression chamber of a first of the rocking cylinders and adapted to be connected to an oxygen source;

an output hose connected to the compression chamber of a second of the rocking cylinders; and a base supporting the rocking cylinders, wherein the housings of the rocking cylinders have first and second distal ends, wherein said first of said distal ends of said housings are pivotally attached to the base.

2. The oxygen-compression apparatus as claimed in claim 1, wherein three rotating wheels are mounted on the driving shaft; and the rotating wheels are located at 120° relative to each other and the central axis of the driving shaft.

3. The apparatus as claimed in claim 2 further comprising multiple check valves attached respectively to the hoses to form a one-way passage between the hoses and the compression chambers of the cylinders.

4. The apparatus as claimed in claim 3, further comprising an oxygen concentration detecting device connected to the input hose to detect the concentration of the oxygen supplied from the oxygen source, and the detecting device comprising a buffer tank;

a filter connected to the buffer tank;

an oxygen sensing unit connected to the filter to detect the concentration of the oxygen; and a restrictor connected to the input hose and electrically connected to the oxygen sensing unit.

5. The apparatus as claimed in claim 1 further comprising multiple check valves attached respectively to the hoses to form a one-way passage between the hoses and the compression chambers of the cylinders.

6. The apparatus as claimed in claim 5, further comprising an oxygen concentration detecting device connected to the input hose to detect the concentration of the oxygen supplied from the oxygen source, and the detecting device comprising a buffer tank;

a filter connected to the buffer tank;

an oxygen sensing unit connected to the filter to detect the concentration of the oxygen; and a restrictor connected to the input hose and electrically connected to the oxygen sensing unit.

7. The apparatus as claimed in claim 1, wherein said piston rods extend into the inner space of the housings at said second distal ends of the housings.

8. The apparatus as claimed in claim 1, further comprising an oxygen concentration detecting device connected to the input hose to detect the concentration of the oxygen supplied from the oxygen source, and the detecting device comprising a buffer tank;

a filter connected to the buffer tank;

an oxygen sensing unit connected to the filter to detect the concentration of the oxygen; and a restrictor connected to the input hose and electrically connected to the oxygen sensing unit.

9. An oxygen-compression apparatus comprising:

a driving device having a driving shaft with a central axis;

multiple rotating wheels eccentrically attached on and rotated with the driving shaft and located respectively at different angles relative to the central axis of the driving shaft ;

multiple driving rings rotatably mounted respectively around the rotating wheels;

multiple rocking cylinders connected respectively to the driving rings, having different compression ratios and each having a housing with an inner space; and a piston rod having a first end extending into the inner space of the housing to form a compression chamber in the inner space and a second end connected to a corresponding one of the driving rings;

multiple connecting hoses respectively connected between the compression chambers of adjacent rocking cylinders, an input hose connected to the compression chamber of a first of the rocking cylinders and adapted to be connected to an oxygen source;

an output hose connected to the compression chamber of a second of the rocking cylinders; and a base supporting the rocking cylinders, wherein the housings of the rocking cylinders are pivotally attached to the base, wherein three said rotating wheels are mounted on the driving shaft; and the rotating wheels are located at 120° relative to each other and the central axis of the driving shaft, further comprising multiple check valves attached respectively to the hoses to form a one-way passage between the hoses and the compression chambers of the cylinders, further comprising an oxygen concentration detecting device connected to the input hose to detect the concentration of the oxygen supplied from the oxygen source, and the detecting device comprising a buffer tank;

a filter connected to the buffer tank;

an oxygen sensing unit connected to the filter to detect the concentration of the oxygen; and a restrictor connected to the input hose and electrically connected to the oxygen sensing unit.

10. An oxygen-compression apparatus comprising:

a driving device having a driving shaft with a central axis;

multiple rotating wheels eccentrically attached on and rotated with the driving shaft and located respectively at different angles relative to the central axis of the driving shaft;

multiple driving rings rotatably mounted respectively around the rotating wheels;

multiple rocking cylinders connected respectively to the driving rings, having different compression ratios and each having a housing with an inner space; and a piston rod having a first end extending into the inner space of the housing to form a compression chamber in the inner space and a second end connected to a corresponding one of the driving rings;

multiple connecting hoses respectively connected between the compression chambers of adjacent rocking cylinders, an input hose connected to the compression chamber of a first of the rocking cylinders and adapted to be connected to an oxygen source;

an output hose connected to the compression chamber of a second of the rocking cylinders; and a base supporting the rocking cylinders, wherein the housings of the rocking cylinders are pivotally attached to the base, further comprising multiple check valves attached respectively to the hoses to form a one-way passage between the hoses and the compression chambers of the cylinders, and further comprising an oxygen concentration detecting device connected to the input hose to detect the concentration of the oxygen supplied from the oxygen source, and the detecting device comprising a buffer tank;

a filter connected to the buffer tank;

an oxygen sensing unit connected to the filter to detect the concentration of the oxygen; and a restrictor connected to the input hose and electrically connected to the oxygen sensing unit.

11. An oxygen-compression apparatus comprising:

a driving device having a driving shaft with a central axis;

multiple rotating wheels eccentrically attached on and rotated with the driving shaft and located respectively at different angles relative to the central axis of the driving shaft;

multiple driving rings rotatably mounted respectively around the rotating wheels;

multiple rocking cylinders connected respectively to the driving rings, having different compression ratios and each having a housing with an inner space; and a piston rod having a first end extending into the inner space of the housing to form a compression chamber in the inner space and a second end connected to a corresponding one of the driving rings;

multiple connecting hoses respectively connected between the compression chambers of adjacent rocking cylinders, an input hose connected to the compression chamber of a first of the rocking cylinders and adapted to be connected to an oxygen source;

an output hose connected to the compression chamber of a second of the rocking cylinders; and a base supporting the rocking cylinders, wherein the housings of the rocking cylinders are pivotally attached to the base, further comprising an oxygen concentration detecting device connected to the input hose to detect the concentration of the oxygen supplied from the oxygen source, and the detecting device comprising a buffer tank;

a filter connected to the buffer tank;

an oxygen sensing unit connected to the filter to detect the concentration of the oxygen; and a restrictor connected to the input hose and electrically connected to the oxygen sensing unit.

* * * * *